US006454253B1

(12) United States Patent
Tranquillla

(10) Patent No.: US 6,454,253 B1
(45) Date of Patent: Sep. 24, 2002

(54) DOCUMENT FEEDER NUDGER BELT FRICTION FORCE CONTROL

(75) Inventor: Michael N. Tranquillla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/924,264

(22) Filed: Aug. 7, 2001

(51) Int. Cl.[7] ..... B65H 3/04

(52) U.S. Cl. ..... 271/34; 73/862.044; 271/31.1; 271/149

(58) Field of Search ..... 271/31.1, 94, 34, 271/149; 73/862.044, 862.045

(56) References Cited

U.S. PATENT DOCUMENTS 4,763,531 A * 8/1988 Dietrich et al. ..... 73/862.044
6,029,971 A * 2/2000 Lynch et al. ..... 271/34
6,123,330 A * 9/2000 Schaal ..... 271/94
6,199,854 B1 * 3/2001 Tranquilla et al. ..... 271/34
6,375,598 B1 * 4/2002 Frame et al. ..... 482/111
6,419,221 B1 * 7/2002 Spall ..... 271/149

* cited by examiner

*Primary Examiner*—H. Grant Skaggs
(74) *Attorney, Agent, or Firm*—Harness, Dickey & Pierce P.L.C.; Lisa A. Rode; Mark T. Starr

(57) ABSTRACT

A method for controlling and adjusting nudger drive friction force. The nudger drive friction force is measured and compared with a desired nudger belt friction force term needed for reliable feeding. Cable drum motor torque is responsively adjusted to obtain a desired nudger drive friction force.

8 Claims, 5 Drawing Sheets

DOCUMENT FEEDER NUDGER BELT FRICTION FORCE CONTROL

FIELD OF THE INVENTION

The present invention relates to document processing equipment, and more particularly to adjusting document nudger drive friction force in a document feeding device.

BACKGROUND OF THE INVENTION

Document feeding devices are commonly used today to quickly move and sort a variety of documents. Documents are often stacked and automatically fed from the document stack. A feeding mechanism, typically including a nudger and a feedwheel/separator nip, is used to introduce each document to its document transport for processing and sorting. It is important to introduce each document singly, with consistent spacing to permit the fastest feed rate possible while still maintaining proper document spacing.

In high-speed equipment, a hopper is often used to supply documents toward the nudger. A stack of documents is placed in the hopper against a flag element, which is used to move the document stack toward the nudger during feeding. To move the document stack, the flag applies a force to the last document in the stack, thereby forcing the stack against a nudger belt.

It is common to apply the flag force with a spring, a weight, or a motor. Most commonly, an electric motor drives a cable drum which is interconnected to the flag element by a flexible cable. By applying an electric current to the motor, a known torque is applied to the drum. Rotation of the drum produces a tension on the flexible cable, and subsequently, a force on the flag element.

As the flag force moves the document stack along the hopper, the stack is supported by a hopper floor and is guided along a leading edge guide wall toward the nudger. Upon reaching the nudger, the nudger belt (driven by a nudger belt pulley) drives the documents from the stack toward the feedwheel/separator nip. At the feedwheel/separator nip, documents are separated to other transports for forwarding to upstream document processing stations and/or to sorters.

As is often the case in conventional systems, the nudger may inadvertently drive more than one document from the stack or may apply a force to a document when the trailing edge of a previous document has not yet left the feedwheel/separator nip. In such a circumstance, depending on inter-document friction and fragility of the document, document leading edge damage, overlapped document feeding, or document jamming may occur if the nudger drive friction force is too large. In contrast, if the nudger drive friction force is too small, a document may slip on the nudger belt and not be driven to the feedwheel/separator nip.

Furthermore, although the electric motor torque may be reliable and consistent, the normal force at the nudger due to the motor may vary due to losses between the motor and the nudger. These losses may be induced by cable bending, cable idler friction, flag guide friction, and/or variable friction between the differing documents and the hopper floor and leading edge guide. Also, the coefficient of friction between the nudger belt and the documents may vary depending upon the documents and the environmental conditions, and the age of the nudger belt material.

It is therefore desirable to adjust the nudger force in response to force changes caused by such variables in order to provide consistent document spacing.

SUMMARY OF THE INVENTION

Accordingly, the present invention is provided to alleviate some of the shortcomings of conventional systems. In a preferred embodiment of the present invention, a nudger drive friction force is measured and compared with a desired nudger belt friction force term needed for reliable feeding. Cable drum motor torque is responsively adjusted to obtain a desired nudger drive friction force.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
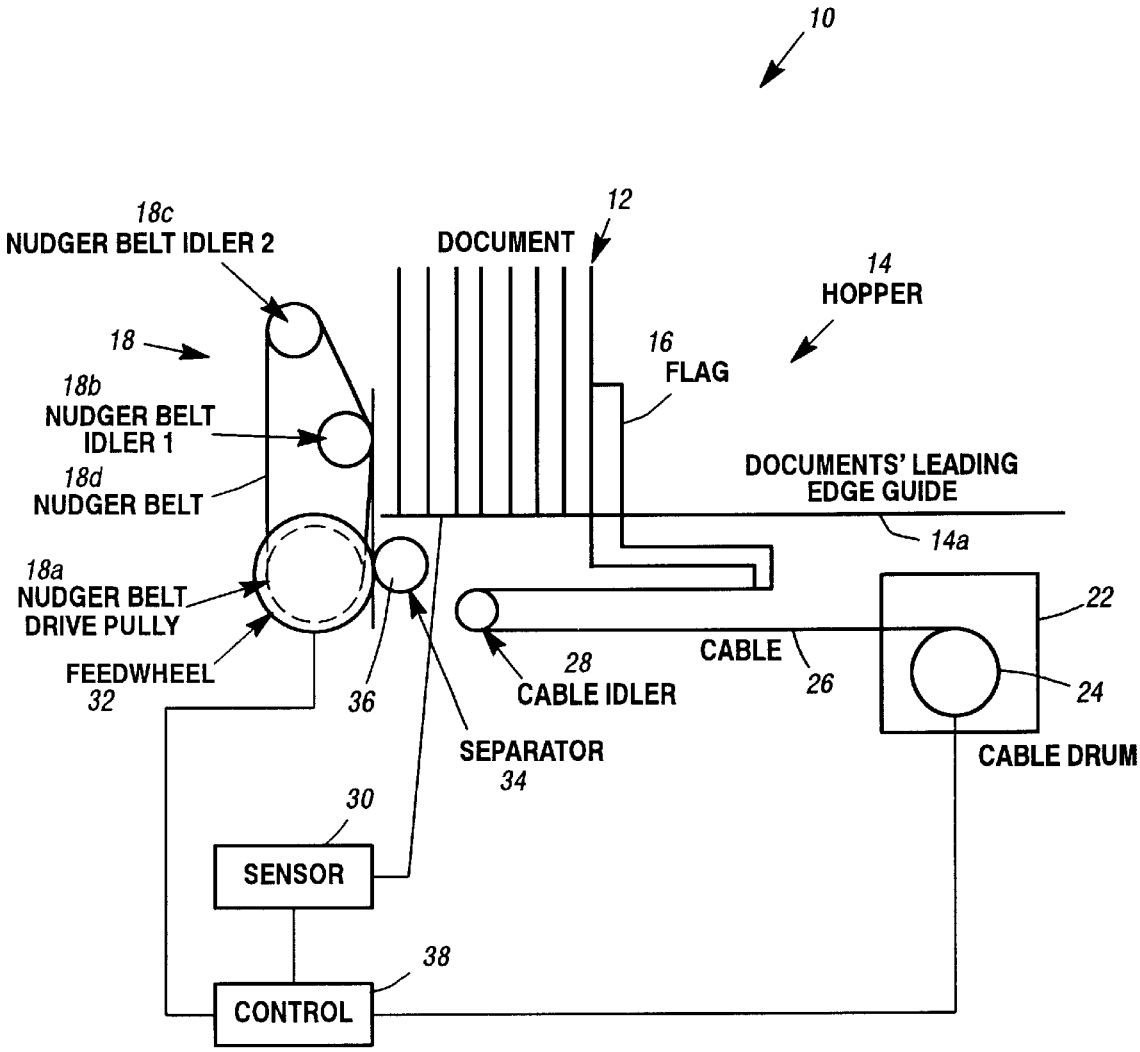
FIG. 1 is a plan view of a preferred embodiment of a document feeder according to the principles of the present invention.

FIG. 1 illustrates the typical elements of a document feeder 10. As shown, a stack 12 of documents is placed in a hopper 14 (details not shown) between a flag element 16 and a nudger 18. The flag element 16 is adapted to apply a flag force on the stack 12, thereby forcing the stack 12 toward the nudger 18. As shown, the nudger preferably includes a nudger belt drive pulley 18*a*, a first nudger belt idler 18*b*, a second nudger belt idler 18*c* and a nudger belt 18*d*. As will be understood by one of ordinary skill in the art, the nudger belt 18*d* is operably disposed around the nudger belt drive pulley 18*a*, the first nudger belt idler 18*b* and the second nudger belt idler 18*c*. The second nudger belt idler 18*c* is preferably positionally adjustable to provide tensioning of the nudger belt 18*d*.

In general, the flag force may be applied using a spring, a weight, or a motor arrangement. In the preferred embodiment shown, an electric motor 22 is adapted to provide a torque for applying the flag force. The electric motor 22 is mechanically coupled to and adapted to rotationally drive a cable drum 24. As shown, the cable drum 24 and the flag element 16 are interconnected by a flexible cable 26 via a cable idler 28. It will be understood that by applying an electric current to the motor 22, a known torque is applied to the cable drum 24, thereby providing tension on the flexible cable 26 which consequently produces a known force on the flag element 16.

The document stack 12 is supported by a hopper floor (not shown) and is guided along a leading edge guide wall 14*a*.

A hopper sensor 30, preferably optically reflective, is adapted to sense whether or not documents are in the hopper 14 and provide a signal in response thereto. If documents are in the hopper 14, the nudger 18 drives the documents from the stack 12 toward a feedwheel 32 and separator 34 via a friction force between the nudger belt 18*d* and the document surface. At a feedwheel/separator nip 36, documents are separated to other transports (not shown) for forwarding to other document processing stations and/sorters. As shown, a control unit 38 communicates with various sensors and electronics, including hopper sensor 30, a feedwheel motor (not shown), and cable drum motor (22).

Figure 2:
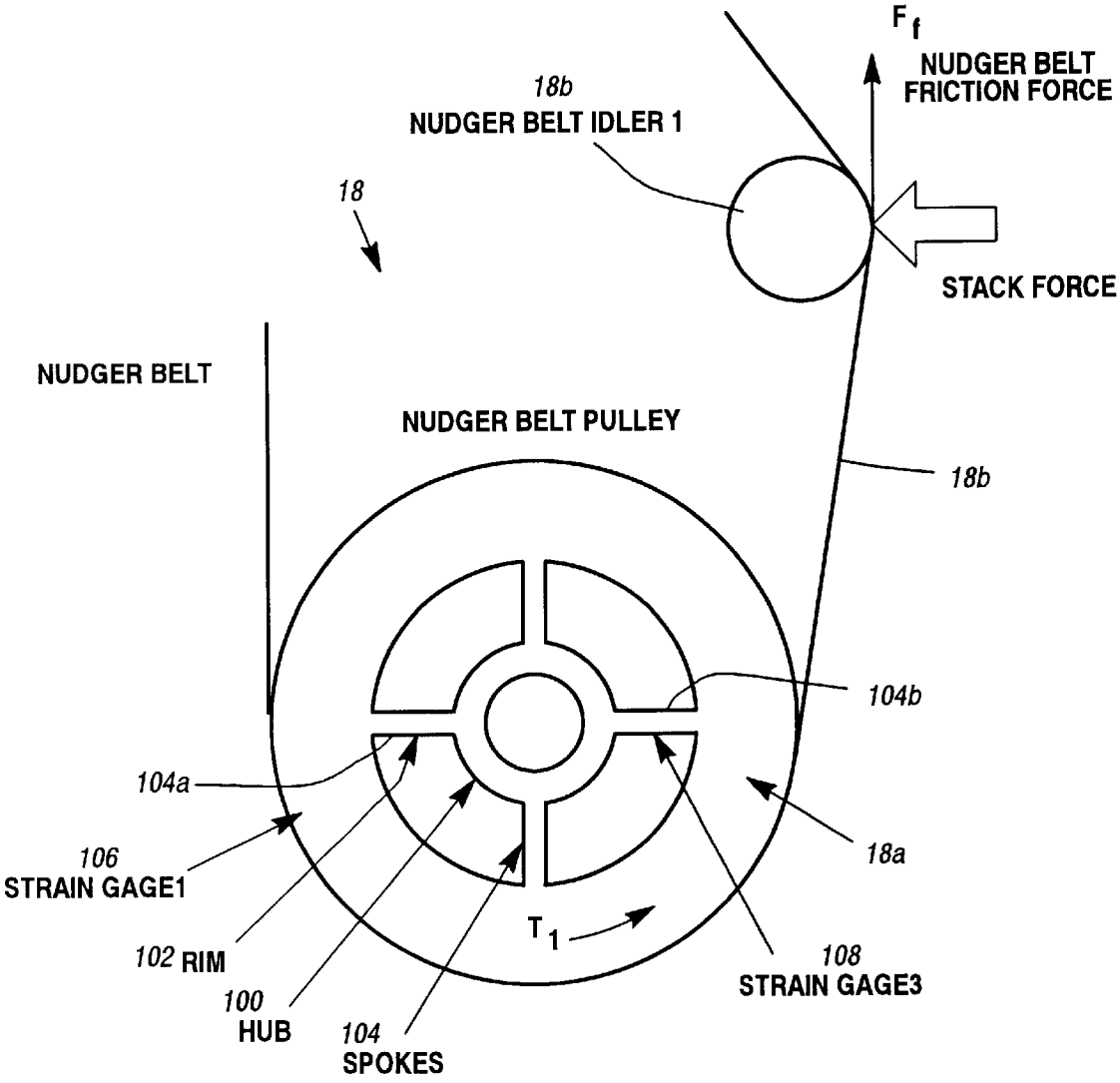
FIG. 2 is partial enlarged view of the nudger shown in FIG. 1.

FIG. 2 shows a more detailed view of the nudger 18. As shown, the nudger belt drive pulley 18*a* includes a hub 100 and a rim 102 interconnected by a plurality of spokes 104. The hub 100 is operably fastened to a feedwheel motor shaft (not shown) by suitable mounting means. The nudger belt 18*d* wraps circumferentially around and is driven by the rim 102.

The spokes 104 are slender relative to the size of the rim 102 and hub 100. As such, if a torque T1, caused by the nudger belt friction force Ff, is applied to the rim 102, the spokes 104 will bend slightly, thereby causing relative rotation between the rim 102 and the hub 100. It is preferable that the spokes 104 remain relatively rigid in the radial direction, which is possible because the spoke 104 is much stiffer in tension/compression than in bending.

As further shown, a pair of strain gages 106 and 108 are bonded to the sides of two opposite spokes 104*a* and 104*b*. As will be appreciated by one of ordinary skill in the art, additional strain gages may be added to the two spokes in order to increase the sensitivity. As is well known, the strain gages 106 and 108 are adapted to change electrical resistance when they are stretched or compressed, commonly called mechanical strain, and to produce a proportional electrical signal in response thereto. As such, a torque T1 may be applied to the nudger drive belt pulley 18*a* as a result of nudger belt friction force Ff. In response, the spokes 104 are subjected to bending stresses and the strain gages 106 and 108 produce a proportional signal in response. It will be understood that if the torque T1 is counterclockwise, the resulting stress in the spokes (and hence, strain in the strain gages) is compressive.

Bending stresses in the spokes 104 are also produced by the torque resulting from tension of the nudger belt 18*d*. For example, in the configuration shown, if the nudger belt pulley 18*a* was rotated counterclockwise, the second strain gage 108 would be in compression while the first strain gage 106 would be in tension. It will be understood that if the rotation was clockwise, the first strain gage 106 would be in compression and the second strain gage 108 would be in tension. If the nudger belt pulley 18*a* was rotated 90 degrees from the position shown, axial stresses would be placed on the spokes 104*a* and 104*b* due to the nudger belt tension Ft.

To cancel out the effects of resistance changes in the strain gages 106 and 108 due to nudger belt tension Ft, yet maintain the effects of resistance changes in the strain gages 106 and 108 due to torque T1 from the nudger belt friction force Ff, the strain gages 106 and 108 are connected in opposite arms of a Wheatstone bridge. The Wheatstone bridge is a commonly known for use in strain gage electronics, and, as such will not be discussed in further detail.

Figure 3:
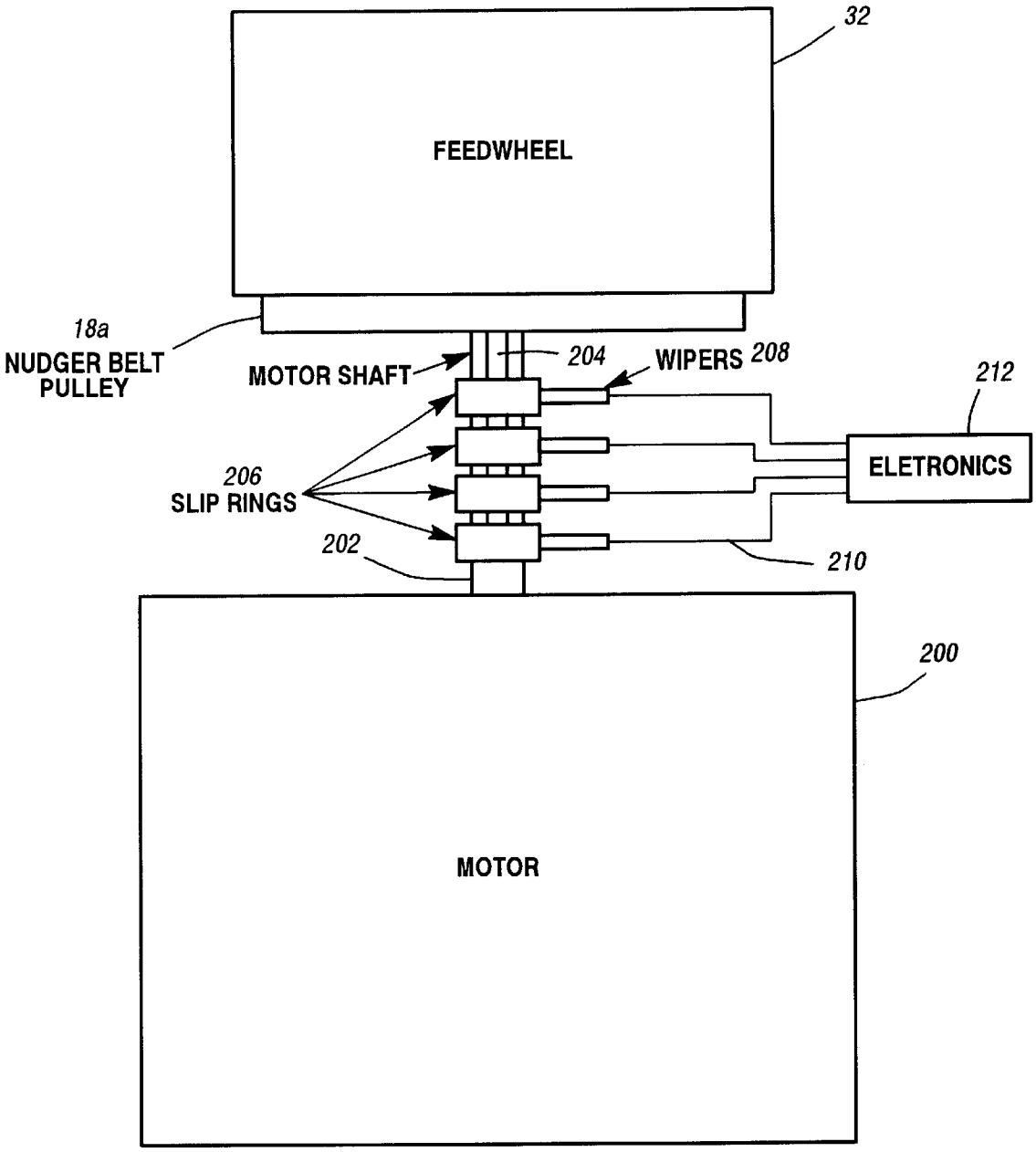
FIG. 3 is an enlarged partial side view of the document feeder of FIG. 1.

FIG. 3 is a side view of the feedwheel 32, nudger belt drive pulley 18*a*, and a drive motor 200 having a drive motor shaft 202. As shown, the feedwheel 32 and nudger belt pulley 18*a* are preferably co-axially attached to the drive motor shaft 202. A plurality of strain gage wires 204 are electronically coupled to the strain gages (not shown) and disposed along the spokes (not shown) toward the hub (not shown) and along the drive motor shaft 202 where they are connected to a plurality of slip rings 206. As shown, the slip rings 206 are fastened to the motor shaft 202. The slip rings 206 include wipers 208 for transferring electrical signals from the strain gages to wires 210 that are then routed to measurement and excitation electronic devices 212. The method of transferring electrical signals to and from a rotating shaft using slip rings is well known to one of ordinary skill in the art, and as such, will not be described in further detail.

Figure 4:
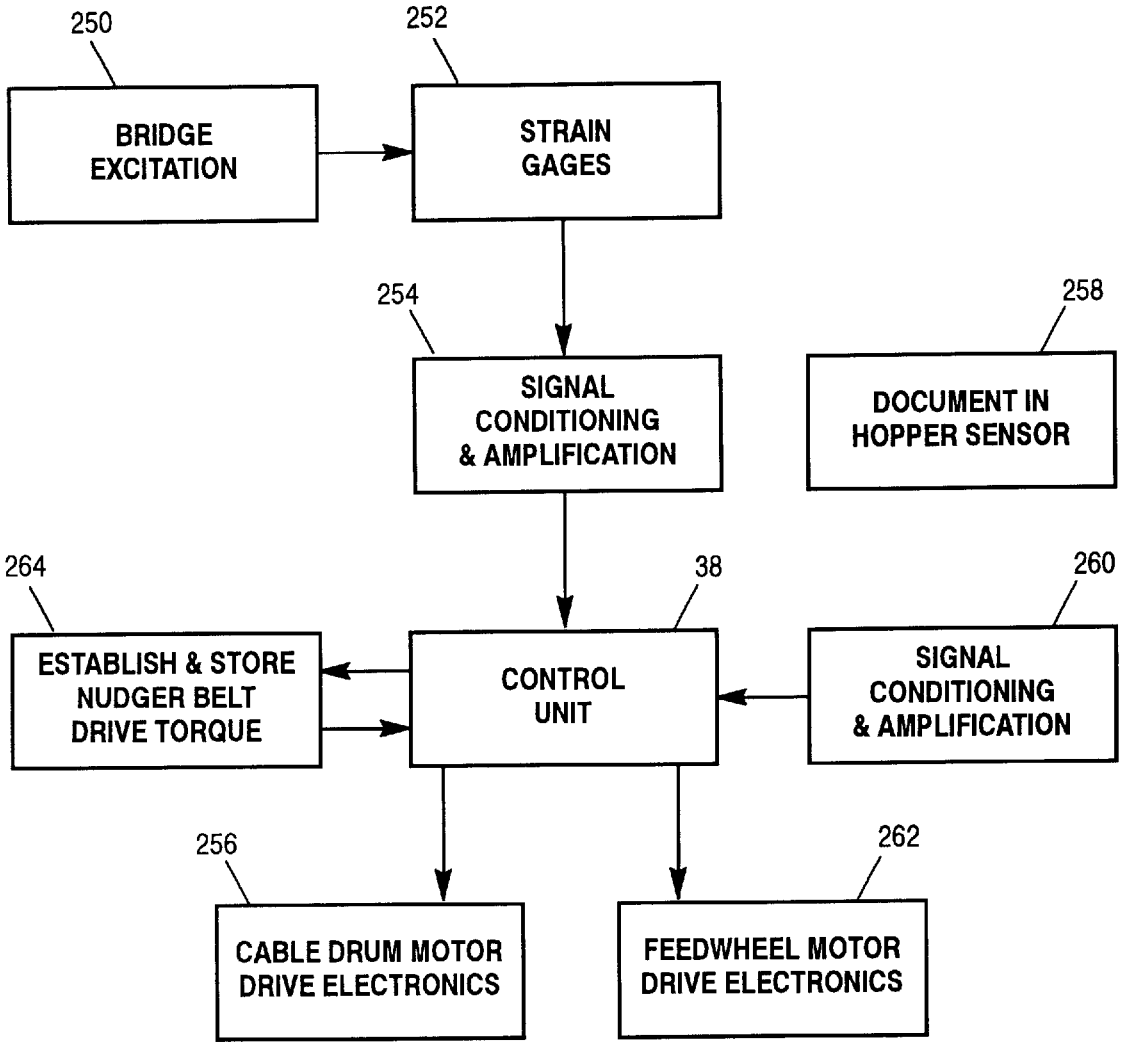
FIG. 4 is a block diagram showing a preferred methodology of the present invention with FIG. 5 giving a related logic diagram.

Turning now to FIG. 4, a block diagram illustrating the electronics of the present invention is shown. As shown in blocks 250 and 252, bridge excitation voltage is applied to the strain gages. The strain gages are connected to a signal conditioning and amplification section (block 254) where two legs of the Wheatstone bridge are completed. When no load is applied, the Wheatstone bridge is balanced, and the relatively small electrical signals are amplified to be easily accepted by the control unit 38 which may be a microprocessor, hard wired logic, analog computer or any combination thereof. Preferably, the control unit 38 is a microprocessor. The control unit 38 is responsible for directing electronics of the cable drum motor (block 256) to supply more or less electrical current to the cable drum motor 22.

In the system, a negative torque is applied to the nudger belt drive pulley due to losses as the nudger belt bends around the nudger belt drive pulley and the nudger idler pulleys and due to rotational friction in bearings (not shown) of the pulleys. This negative torque must be subtracted from a measured torque value during document feeding. To accomplish this, an electrical signal from the hopper sensor 30 is utilized to determine if documents are present. As shown in blocks 258 and 260, a signal from the hopper sensor is conditioned and amplified and then sent to the control unit 38. When no documents are present, the control unit 38 instructs the electronics of the feedwheel motor (block 262) to run for a short period of time, during which the nudger belt drive pulley torque is measured and stored as a reference torque value (block 264). The reference torque value is readily accessible for future operations, such as when documents are being fed.

Figure 5:
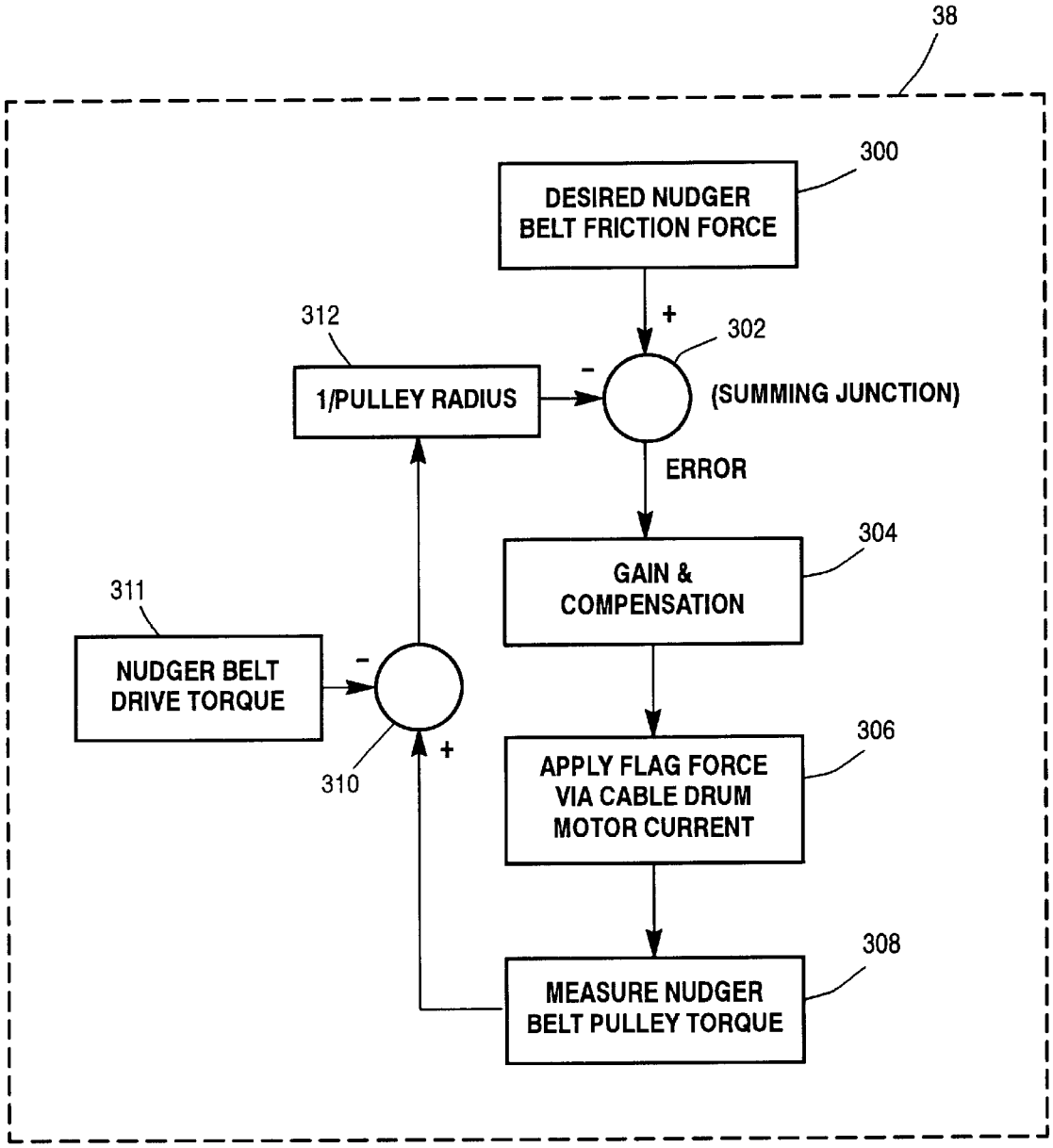

With cross-reference to FIG. 5, the control unit 38 performs the operations to instruct the cable drum motor drive electronics (block 256). As shown in block 300, a desired nudger belt friction force term is stored in the control unit 38. From block 300, the method advances to summing junction 302, where the desired nudger belt friction force term and measured force values are compared. In the summing junction 302, an error term is determined. From the summing junction 302, the method advances to block 304, where the error term is multiplied by gain and compensation algorithms which are commonly known in feedback control systems to produce a corresponding signal. The gain and compensation algorithms minimize steady state error while maintaining system stability. These techniques are familiar to those practiced in the art of feedback control systems.

From process block 304, the methodology advances to process block 306. In block 306, the signal is translated into a cable drum motor current to increase or decrease the flag force as required. From block 306, the method advances to block 308. In block 308, nudger belt pulley torque is measured to provide a measured nudger belt pulley torque term. The methodology advances to a summing junction 310. As shown, the summing junction 310 corrects for the measured nudger belt pulley torque and the nudger belt drive torque (block 311). In block 312, the result from the summing junction 310 is divided by the radius of the nudger drive pulley to produce the measured nudger belt friction force. The measured nudger belt friction force is then fed back to the summing junction 302 to be compared to the desired nudger belt friction force.

Accordingly, the nudger belt friction force can be controlled by adjusting the flag force applied to the document stack, thereby providing an improved document feeding system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In a document feeder having a nudger, a cable drum coupled to a cable drum motor, wherein the cable drum motor is adapted to produce a torque, and a flag element coupled to the cable drum and adapted to produce a flag force on a document stack, a method for controlling and adjusting nudger drive friction force comprising:

forming a nudger drive pulley having a rim, a hub, and a plurality of spokes adapted to interconnect said rim and said hub;

selectively mounting a plurality of sensors on said spokes;

determining a measured nudger drive friction force term;

determining a desired nudger drive friction force term; and selectively adjusting the cable drum motor in response to a difference between said desired nudger drive friction force term and said measured nudger drive friction force term.

2. The method as recited in claim 1 wherein the step of determining a measured nudger drive friction force term includes measuring and storing a nudger belt drive pulley torque value when no documents are present in the document stack.

3. The method as recited in claim 1 wherein said sensors include a first sensor and a second sensor each mounted on at least one of said spokes.

4. The method as recited in claim 3 wherein said sensors are strain gages, each of said strain gages being connected to a Wheatstone bridge.

5. An apparatus for controlling nudger belt friction force in a document feeder, comprising:

a nudger belt drive pulley having a hub and a rim interconnected by a plurality of spokes, said spokes adapted to bend in response to a nudger belt friction force applied to said rim; and a plurality of sensors selectively mounted to said spokes for sensing bending stresses in said spokes and producing a proportional signal in response thereto.

6. The apparatus of claim 5, further comprising:

a control system electronically coupled to said plurality of sensors and to a cable drum motor, wherein said cable drum motor is electronically adjustable to provide a desired nudger belt friction force.

7. An apparatus for controlling nudger belt friction force in a document feeder, comprising:

a nudger belt;

a feedwheel motor having a feedwheel motor shaft;

a nudger belt drive pulley having a hub operably connected to said feedwheel motor shaft, a rim, and a plurality of spokes interconnecting said hub and said rim, said spokes adapted to bend in response to a nudger belt friction force applied to said rim via said nudger belt;

a first strain gage mounted to one of said spokes for sensing bending stresses therein and producing a first proportional electronic signal in response thereto;

a second strain gage mounted to another of said spokes for sensing bending stresses therein and producing a second proportional signal in response thereto;

a plurality of slip rings electronically coupled to said first and second strain gages and adapted to receive said first and second signals from said strain gages; and a control unit electronically coupled to said plurality of slip rings and adapted to receive electronic signals therefrom to control nudger belt friction force.

8. The apparatus recited in claim 7, wherein said control unit is electronically coupled to a cable drum motor, wherein said cable drum motor is electronically adjustable to provide a desired nudger belt friction force.

* * * * *